United States Patent [19]

Eheim et al.

[11] Patent Number: 4,519,352

[45] Date of Patent: May 28, 1985

[54] CONTROLLING DEVICE FOR A FUEL-QUANTITY ADJUSTING MEMBER OF A FUEL INJECTION PUMP

[75] Inventors: Franz Eheim, Stuttgart; Gerald Höfer, Weissach-Flacht; Karl Konrath, Ludwigsburg; Max Straubel, Stuttgart, all of Fed. Rep. of Germany

[73] Assignee: Robert Bosch GmbH, Stuttgart, Fed. Rep. of Germany

[21] Appl. No.: 425,810

[22] Filed: Sep. 28, 1982

[30] Foreign Application Priority Data

Dec. 2, 1981 [DE] Fed. Rep. of Germany ..... 3147701

[51] Int. Cl.[3] ..... F02M 59/24; F02M 59/42

[52] U.S. Cl. ..... 123/373; 123/449; 123/179 L

[58] Field of Search ..... 123/373, 449, 179 L, 123/364, 365

[56] References Cited

U.S. PATENT DOCUMENTS

| | | | |
|---|---|---|---|
| 3,970,064 | 7/1976 | Eheim | 123/373 |
| 3,970,066 | 7/1976 | Schmitt | 123/373 |
| 3,974,812 | 8/1976 | Konrath | 123/373 |
| 3,974,814 | 8/1976 | Eheim | 123/373 |
| 4,239,025 | 12/1980 | Konrath | 123/179 L |
| 4,253,438 | 3/1981 | Zibold | 123/179 L |

*Primary Examiner*—Charles J. Myhre
*Assistant Examiner*—Carl Stuart Miller
*Attorney, Agent, or Firm*—Edwin E. Greigg

[57] ABSTRACT

A fuel injection pump including a control device is proposed in which a control lever which determines the fuel injection quantity is placed at an adjustable spring which is not supported by the main power source of a governor lever. The control lever is subjected to lesser forces provided by the intended auxiliary springs, starting springs or idling springs.

4 Claims, 7 Drawing Figures

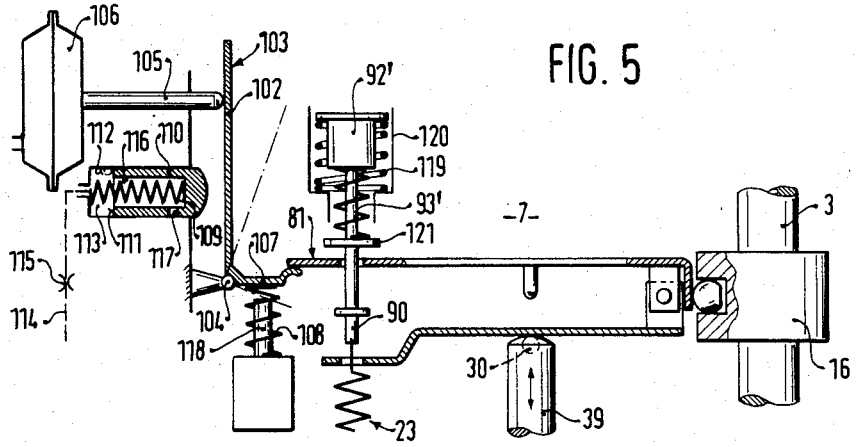
FIG. 5
FIG. 6
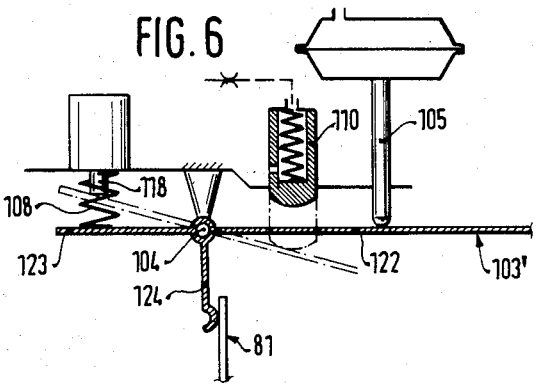
FIG. 7
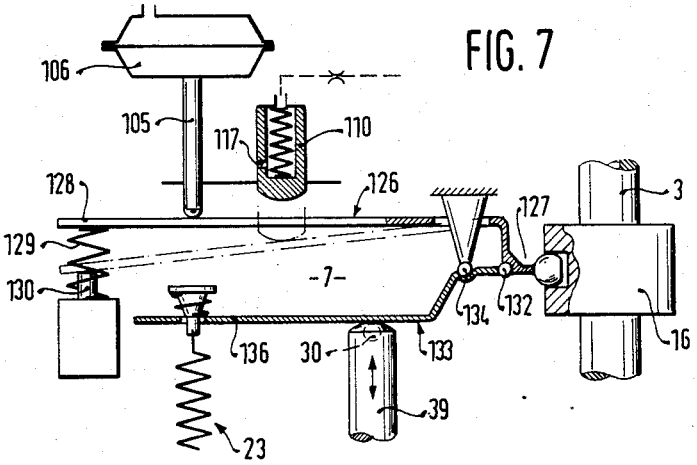

CONTROLLING DEVICE FOR A FUEL-QUANTITY ADJUSTING MEMBER OF A FUEL INJECTION PUMP

BACKGROUND OF THE INVENTION

The invention is based on a controlling device as revealed hereinafter. In a controlling device of this kind, such as that known from the ASME-Publication 78-DGP-7 and German Offenlegungsschrift No. 24 02 374, an adjustable full-load fuel stop is proposed which limits the drag lever in adjusting direction of the excess fuel. This lever is, based on the initially referenced publication, also adjustable in interdependency with the charge-air pressure.

The known controlling device has the disadvantage that the drag lever effected by the high pressure of the governor spring layout exerts relatively high force on the adjustable stop. Thus, adjustment of the stop results in high friction causing distinct hysteresis behavior at full-load adjustment. This behavior proves even more disadvantageous during injection with a load-pressure dependent adjustment at the injection pump, since the adjustment errors are considerably amplified with an increase in rpm and load. The reason being, that charging characteristics and feed-pressure are dependent upon the load and are becoming more dependent with increased rpm and thus influence the adjustment characteristics set forth by the requirements of the combustion engine, thereby also resulting in a leveling off of adjustment quantity. For example, vibrations and natural oscillations transmitted to the injection pump at full-load operation and fuel regulation of the fuel of the full-load injection quantity occur much earlier resulting in a speed adjustment with insufficient fuel quantity. Massive acceleration and forces exerted by the governor spring on the full-load fuel stop cause the abutted parts to be affected and thus the oscillating amplitudes of these parts are increased, resulting in the simulation of a decreased fuel injection quantity.

OBJECT AND SUMMARY OF THE INVENTION

The controlling device according to the invention, has the advantage over the prior art that the control lever which determines the fuel injection quantity is positioned relative to an adjustable spring of the apparatus which is not supported by the main power source of the governor lever, but is subjected to lesser forces provided by the auxiliary springs, such as starting or idling springs. After engaging the full-load stop and coupling the stop with the drag lever, full power of the governor lever is exerted onto the control lever and its actuating element. Consequently, there are fewer hysteresis errors. At the same time, the force abutting the control lever decreases and its vibrating tendency is lessened by the adjustable stop means.

Advantageous further embodiments and improvements to the apparatus are attainable by means of the characteristics disclosed herein.

The invention will be better understood and further objects and advantages thereof will become more apparent from the ensuing detailed description of the preferred embodiments taken in conjunction with the drawings.

BRIEF DESCRIPTION OF THE DRAWINGS

Seven exemplary figures of the invention are shown in the drawing and are more clearly defined in the following description:

FIG. 5 shows an exemplary embodiment of a correcting lever as in FIG. 4 which is disengaged to regulate the starting injection quantity;

FIG. 6 shows an exemplary embodiment of an alternate method of adjusting the full-load stop, particularly while starting the combustion engine, and FIG. 7 shows an exemplary embodiment of a control lever which pivots around the drag lever, and a further variant of adjusting the full-load stop, in particular during the start of the combustion engine.

DESCRIPTION OF A PREFERRED EMBODIMENT

Figure 1:
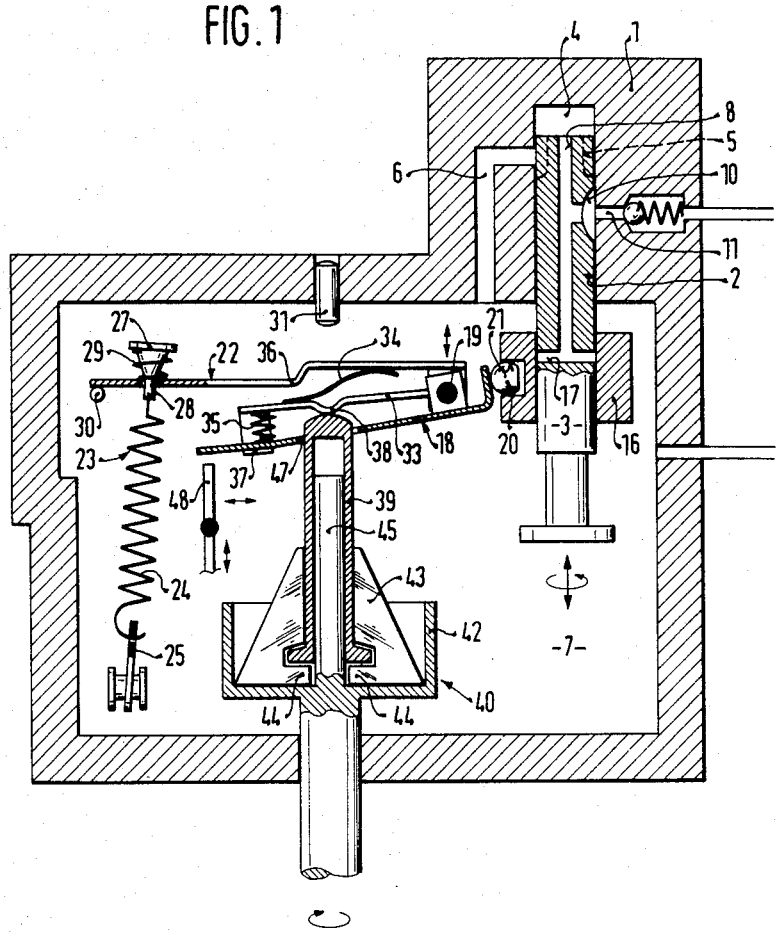
FIG. 1 shows a first exemplary embodiment of a schematic view of a distributor injection pump operated by a drag lever and control lever by means of an intermediate lever.

A pump piston is driven by a drive means to simultaneously reciprocate and rotate within a cylinder 2 of a housing 1 of a fuel injection pump by any well-known means which is not shown. A pump work chamber 4 of this pump is supplied with fuel from a suction chamber 7 via longitudinal grooves 5 disposed on the jacket face of the pump piston 3 and via a conduit 6 extending within the housing 1 from the longitudinal grooves 5 to the suction chamber 7 as long as the pump piston is executing its intake stroke.

Upon onset of a compression stroke subsequent to a corresponding rotation by the pump piston, the fuel located in the pump work chamber 4 is pumped into a longitudinal conduit 8 within the pump piston 3 from which the fuel flows via a longitudinal distributor groove 10, corresponding with the rotating position of the pump piston to an aligned fuel pressure line 11 which is located in the circumference of cylinder bore 2 and corresponds in number to the number of motor cylinders.

An annular slide element 16 surronds a portion of the pump piston and is displaced on the pump piston 3 to open a radial bore 17 which communicates with the longitudinal conduit 8 in the pump piston during the duration of the compression stroke of the pump piston. Movement of slide element 16 thus determines shut-off of the fuel supply from the pump piston to the pressure lines 11. The time at which radial bore 17 communicates with the pump suction chamber to shut off the fuel supply to pressure lines 11 is dependent upon the position of the annular slide element 16 relative to the pump piston 3. The farther the annular slide element is displaced toward the top dead center of the pump piston, the greater the amount of fuel is supplied from the pump piston to the pressure lines 11 and to the fuel nozzles.

The annular slide element is displaced relative to pump piston 3 by a dual-arm starting lever 18 which pivots around pivot shaft 19. The pivot shaft 19 is thereby more favorably displaceable through an eccentric bushing (not shown), for example, through the setting rocker referred to in the Deutsche Offenlegungsschrift 28 44 911. To displace the annular slide element, a head 20 extends into a recess 21 of the annular slide element and is secured to an end of the starting lever 18.

In addition to starting lever 18, an intermediate arm 33 and a drag lever 22 are independently pivotable around shaft 19. In an exemplary embodiment, a main governor spring 24 is connected at one end with an arbitrarily adjustable lever 25, and the other end is attached to a spring plate 27 which includes a guide pin which extends through a bore 28 in one end of the drag lever 22 which holds an idling governor spring 29 in place. Through governor spring assembly 23, the drag lever 22 can be moved in one direction to stop 30 which is fixed in housing 1 at the same time drag lever 22 is adjustable in a direction away from stop 30. The swivel motion of drag lever 22 in the opposite direction of the force exerted by the governor spring is defined by an additional stop 31. Furthermore, intermediate arm 33 located between drag lever 22 and the adjusting lever 18 pivots around shaft 19. A starting spring or pressure spring 34 is located between intermediate lever 33 and drag lever 22 and secured at one end only to either lever to provide a pressure spring between intermediate lever 33 and drag lever 22. It is preferable that the leaf spring be of known design. The swivel motion of the intermediate lever 33 toward drag lever 22 is defined by a first stop 36 which is formed by a bend in drag lever 22.

A pressure spring 35 is located between intermediate lever 33 and the adjusting lever 18 which adjusts lever 18 away from the intermediate lever. The pivoting motion between intermediate lever 33 and the adjusting lever is restricted by a second stop 37 which may be fixed as a part of the intermediate lever 33, or as a part of the adjusting lever 18.

The intermediate lever 33 is provided with a curved portion 38 which is in contact with and displaced by an adjusting sleeve 39 which forms a part of a flyweight adjuster. The flyweight adjuster is operated by a transmission device which is well-known in the art in accordance with the rpm-movement of the pump piston and embodies a carrier plate 42 which contains flyweights 43. The flyweights have nose-shaped parts 44 which attach the flyweights at the lower rim of adjusting sleeve 39. The adjusting sleeve 39 is movable in a longitudinal direction on shaft 45 of the flyweight adjuster. The adjusting sleeve protrudes through a bore 47 in adjusting lever 18 in order to contact stop 38 which is formed on intermediate lever 33. An adjustable stop 48 is provided to set the topmost position of the annular slide element 16. The topmost position of the annular slide element permits the maximum fuel flow through the pump piston by entirely closing off bore 17 in the pump piston 3. Dependent upon operating parameters, the stop 48 is adjustable in the pivoting direction of the adjusting lever 18. In fuel-injection pumps of supercharger-type combustion engines, the adjustable stop 48 is adjustable dependent upon load pressure. Additionally, adjustment is also possible in interdependency with the atmospheric pressure, i.e., generally the density of the air introduced into the combustion chamber of the combustion engine. During starting of the engine, which necessitates increased fuel quantity to be injected into the combustion engine, the adjustable stop 48 is moved to a position so that it cannot be contacted by the adjusting lever for maximum fuel injection quantity. This is achieved by either transversal or longitudinal movement of the stop in accordance with set parameters during starting of the combustion engine. Exemplary embodiments for such releases of the adjustable stop are defined in the following description.

The above referenced assembly functions as follows: During starting of the combustion engine, the adjustable stop 48 is moved so that it cannot contact the adjusting lever 18, starting spring 34 moves intermediate lever 33 from the drag lever to the initial position of adjusting sleeve 39, and adjusting lever 18 abuts stop 37 by means of auxiliary spring 35. Consequently, the annular slide element 16 assumes its topmost position on the pump piston in accordance with the full-load fuel injection quantity. Upon starting of the engine, which causes an increased rpm, adjusting sleeve 39 is displaced due to operation of the flyweights 43 to force intermediate lever 33 against first stop 36 on drag lever 22. Intermediate lever 33 simultaneously displaces adjusting lever 18 by way of stop 37; adjusting lever 18 thereby displaces the annular slide element in the direction of decreased fuel-injection quantity. Further displacement of the adjusting sleeve 39 causes the adjusting sleeve to actuate and displace intermediate lever 33 as well as drag lever 22 against the force of the governor spring assembly 23. Thus, the drag lever is initially pivotable from stop 30 toward the idling governor spring 29. Further increase in rpm will result in displacement of drag lever 22 communicating with the remaining levers, and after reaching breakaway speed the annular slide element 16 is displaced downward in the direction of lowest fuel injection quantity. Based on the load, i.e., the initial compression of the governor spring 23, the fuel injection quantity is variable in relation to the prevailing rpm. Maximum fuel injection is reached at full load and is limited by the adjustable stop 48 following starting of the combustion engine. Upon reaching full-load fuel injection quantity, the adjusting lever 18 is then in communication with adjustable stop 48, regardless of whether drag lever 22 is already abutting stop 30.

Intermediate lever 33 and drag lever 22 are released from stop 30 by the outward movement of adjusting sleeve 39 upon reaching the selected full-load breakway speed. After a short distance of movement, the adjusting lever will be engaged by stop 37, and the annular slide element 16 is displaced.

This embodiment shows the advantage that at full load the drag lever 22 is supported by stop 30. The adjusting lever 18 abutting the adjustable stop 48 merely transfers the pressure of the starting spring 34 in the direction of the stop, i.e., a portion of the pressure exerted by the support spring 35 is dependent upon the adjustment of the stop 48. Thus, the adjustable stop 48 which determines the full-load injection quantity is only deterred by minimal pressure, and subsequently adjustable by minimal force. Hysteresis behavior in adjusting the stop 48 due to occurring friction forces is thus kept to an absolute minimum.

Furthermore, when compared to prior art the oscillating mass effecting adjustment of the annular slide element 16 during full load is considerably reduced. Support spring 35 in cooperation with stop 37 thereby assumes the maximum adjustment distance of adjustable stop 48 in its function as a full-load stop relative to adjusting lever 18.

Figure 2:
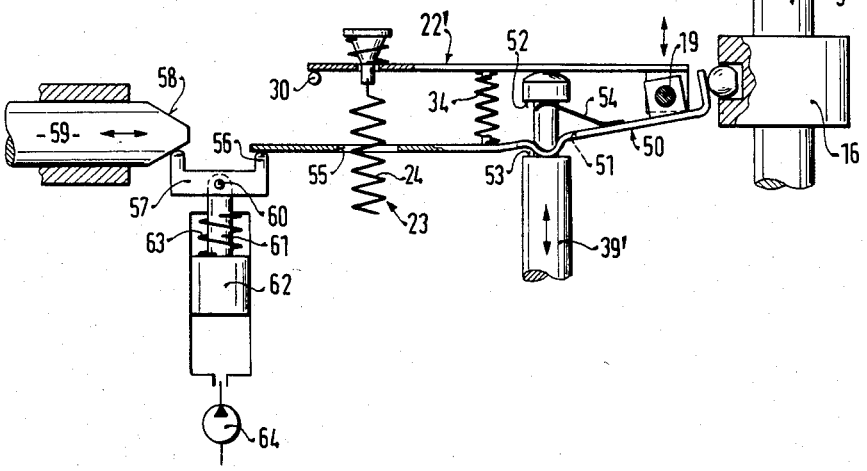
FIG. 2 shows an exemplary embodiment in which the drag lever is connected with the control lever by means of an actuating element.

FIG. 2 is basically identical to the before-mentioned fuel-injection pump, which includes an annular slide element 16 displaceable on the pump piston 3, the annular slide element is displaced by a dual-arm adjusting lever 50. This lever pivots around adjustable shaft 19 and includes a bore 51 through which an adjusting sleeve 39′ protrudes. This adjusting sleeve is identical to the one described in the exemplary embodiment of FIG. 1 and includes flyweight governor 40, which is not shown for simplification of the drawing. The adjusting sleeve can also be actuated by an rpm-dependent pressure by a respective governor lever assembly. Above the lever 50, the adjusting sleeve includes an upper stop 52 and below the lever 50, a lower stop 53 is provided which defines the relative movement between adjusting sleeve 39′ and adjusting lever 50. By means of a support spring 54 which is secured to the adjusting lever and supported by the upper stop 52, adjusting lever 50 is stabilized on the lower stop 53 of adjusting sleeve 39′. Beyond upper stop 52, the head of adjusting sleeve 39′ is in contact with drag lever 22′ which, as in the first exemplary embodiment, is designed as a one-arm lever pivotable around a shaft 19. The drag lever movement is effected by governor spring assembly 23 and the pivoting action of the drag lever 22′ in the direction of the return pressure of the governor spring is defined by a stop 30.

Between drag lever 22′ and adjusting lever 50 a starter spring 34 is provided, its function being to separate drag lever 22′ from adjusting lever 50. The adjusting lever 50 further embodies a second bore 55 through which a governor spring 24 protrudes. The outer end of the adjusting lever 50 communicates with an adjustable stop 56 which, in this instance, represents part of rocker 57 that directly or indirectly scans contour 58 which is provided on a movable pin 59. This pin is adjustable in accordance with operating parameters, and in particular the density of the air introduced into the combustion chambers.

The rocker 57 is secured on the piston rod 61 and is arranged to be reciprocated by means of piston 62. On one side, piston 62 is loaded by a return spring 63, and on the other side by the pressure of a fuel pump 64 supplying fuel to suction chamber 7 of the fuel-injection pump. Without any pressure below piston 62, upon stopping of the fuel injection pump, the return spring 63 forces piston 62 toward the fuel pump which causes the adjustable stop 56 to be deflected downwardly from its actuating position at adjusting lever 50. Movement of stop 56 downwardly permits the adjusting lever to move downwardly. Since the engine is not operating, the flyweights permit adjusting sleeve 39′ to move downwardly. Adjusting lever 50 is then permitted to move to its lowermost position, whereby the annular ring element 16 is displaced to its topmost position which is in the position for a full-load fuel injection quantity. At start of the engine, adjusting sleeve 39′ is deflected upwardly along with adjusting lever 50 to counter the force exerted by starter spring 34 to a point, where the head of the adjusting sleeve 39′ contacts drag lever 22′. At that point adjusting sleeve 39′ further operates counter to the force of governor spring assembly 23, and the drag lever is deflected as rpm increases. At the same time, upon development of additional pressure after start of the engine, rocker 57 and the adjustable stop 56 are deflected into operating position due to fuel pressure on piston 62. During the transition from partial load operation to full-load operation, the pivoting motion of adjusting lever 50 can thus be discontinued independently from the position of the drag lever 22′, by the adjusting sleeve 39′. Thus, the adjusting lever as decribed in the exemplary embodiment, FIG. 1, is only exposed to minor spring pressures, namely those exerted by starter spring 34 and support spring 54, so that only minor forces are transmitted to the contour of pin 59. The frictional pressures during scanning of the contour are consequently kept at a minimum, thereby resulting in a respective reduction in hysteresis behavior. This construction, as compared to the first exemplary embodiment, has the advantage that it necessitates only two levers, and that the pressure imposed on the adjustable full-load stop 56 by a portion of the lever arrangement is even less.

Figure 3:
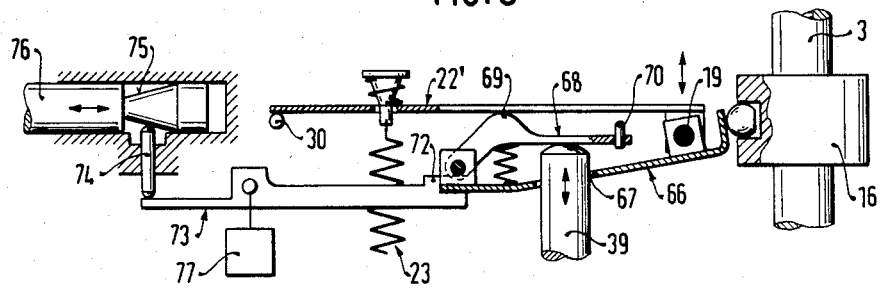
FIG. 3 shows an exemplary embodiment of the drag lever joined with the control lever by means of an idler arm.

FIG. 3 is a variant of FIG. 1, showing an intermediate lever. In this construction, drag lever 22′ is pivotable around shaft 19. Governor spring 23 acts upon the drag lever to bring drag lever 22′ in contact with stop 30. As in the other exemplary embodiments the drag lever is farthest removed from the control sleeve 39. In addition, this construction also provides for an adjusting lever 66 designed as a dual-arm lever pivotable around shaft 19. One arm of the adjusting lever 66 in turn acts upon annular slide element 16, whereas the other arm includes a bore 67 through which the adjusting sleeve 39 extends. At the top of this adjusting lever arm 66, an intermediate lever arm 68 is secured and extends in the direction of shaft 19. The intermediate lever arm is located between adjusting lever 66 and drag lever 22′ and is in an operating relationship with adjusting sleeve 39. The intermediate lever is provided with a raised portion to provide a first stop 69 and is provided with a second stop 70 near one end. Both stops are situated to communicate with drag lever 22′; adjusting sleeve 39 engages the intermediate lever arm between and on the other side of the intermediate lever from stops 69 and 70. The first stop 69 is on a higher plane than second stop 70, so that a deflection of the intermediate lever 68 will initially result in the first stop 69 communicating with drag lever 22′, and only by following a tilting motion around first stop 69, the second stop 70 is brought into communication with drag lever 22′. During this tilting motion the adjusting lever 66 is deflected from drag lever 22 in a pivoting motion.

When the intermediate lever is tilted sufficiently for stop 70 to engage drag lever 22, the adjusting lever 66 is forced downwardly to engage an adjustable stop 72 at one end of rocker arm 73 which determines the full-load position of adjusting lever 66, at which position the annular slide element 16 is positioned at its highest point which results in a maximum fuel-injection quantity at the start of the combustion engine. As in the exemplary embodiment of FIG. 2, the adjustable stop consists of a rocker 73. The other end of the lever arm of rocker 73 engages a scanning pin 74 which rides against a contour 75 of an adjustable pin 76. As in the beforementioned embodiments, the pin 76 is adjustable in accordance with established operating parameters. It is further possible to provide a release member 77 which includes a pressure piston 62 and piston rod 61 as shown in element 16, whereas the other arm includes a bore 67 which is protruded by the adjusting sleeve 39. At the outer end of this adjusting lever arm 66, an intermediate lever arm 68 is secured and extends in the direction of shaft 19. The intermediate lever arm is located between adjusting lever 66 and drag lever 22′ and is in an operating relationship with adjusting sleeve 39. The intermediate lever is provided with a raised portion to provide a first stop 69 and is provided with a second stop 70 near one end. Both stops are situated to communicate with drag lever 22'; adjusting sleeve 39 engages the intermediate lever arm between and on the other side of the intermediate lever from stops 69 and 70. The first stop 69 is on a higher plane than second stop 70, so that a deflection of the intermediate lever 68 will initially result in the first stop 69 communicating with drag lever 22', and only by followig a tilting motion around first stop 69, the second stop 70 is brought into communication with drag lever 22'. During this tilting motion the adjusting lever is deflected from drag lever 22 in a pivoting motion.

When the intermediate lever is tilted sufficiently for stop 70 to engage drag lever 22', the adjusting lever 66 is forced downwardly to engage an adjustable stop 72 at one end of rocker arm 73 which determines the full-load position of adjusting lever 66, at which position the annular slide element 16 is positioned at its highest points which results in a maximum fuel-injection quantity at the start of the combustion engine. As in the exemplary embodiment of FIG. 2, the adjustable stop consists of a rocker 73; the other end of the lever arm of rocker 73 engages a scanning pin 74 which rides against a contour 74 of an adjustable pin 76. As in the beforementioned embodiments, the pin 76 is adjustable in accordance with established operating parameters. It is further possible to provide a release member 77 which includes a pressure piston 62 and piston rod 61 as shown in FIG. 2 for controlling the rocker 73.

The tilting motion around first stop 69 to the point of engagement of the second stop 70 with the drag lever 22' represents the adjusting extent of the adjustable stop 72. If the intermediate lever 68 is pivoted around stop 69 in a counter-clockwise fashion, adjusting lever 66 is forced in a direction from drag lever 22' to increase the fuel-injection quantity. At full load when drag lever 22' is communicating with stop 30, adjusting lever 66 can move freely without the high forces of the governor spring assembly 23 being exerted on the adjustable stop 72. The adjustable stop 72 is only stressed by the sleeve pressure 39 reduced by the transmission ratio of the lever assembly. When compared to the prior art, the pressure imposed on the stop 72 is reduced considerably so that hysteresis errors are low. As known from the prior art, a starter spring can be placed between adjusting lever 66 and drag lever 22', and an adjusting spring can be placed between intermediate lever 68 and drag lever 22' in the area of second stop 70.

Figure 4:
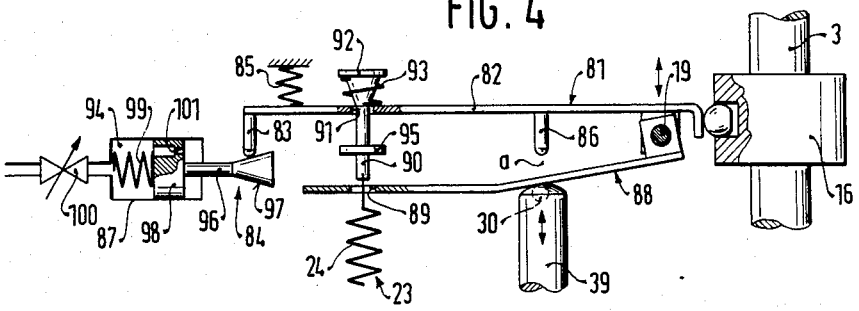
FIG. 4 shows an exemplary embodiment with a correcting lever controlled by a drag lever.

An extended exemplary embodiment as in FIG. 4 (also shown in FIG. 2) differs in that only two levers are provided for regulating the fuel-injection quantity. It provides an arm adjusting lever 81 including two portions which pivot around an adjustable shaft 19, with one arm portion being coupled with the annular slide element 16. The other arm portion 82 of the adjusting lever 81 shows a pin 83 secured to the end opposite from annular slide element 16 which communicates with an adjustable stop assembly 84. Starter spring 85 is housed in a fixed casing and firmly presses the adjusting lever 82 against adjustable stop assembly 84. The other lever arm 82 of the adjusting lever 81 includes a coupling device in the form of a stop 86 which moves in the direction of a drag lever 88 which also pivots on shaft 19. The drag lever 88 is thereby positioned between the adjusting lever 81 and the actuating element such as an adjusting sleeve 39 which engages the drag lever 88. Drag lever 88 is further provided with a fixed stop 30. At one end, drag lever 88 is provided with a bore 89 through which an armature 90 attached to the main governor spring assembly 23 extends. Armature 90, disposing a spring plate 92 at one end, further protrudes through a bore 91 near the end of lever arm 82 of adjusting lever 81, with an idling spring 93 disposed between the spring plate 92 and the adjusting lever 81. As shown by way of example, armature 90 is provided with a driving device, in the form of a disc-shaped stop 95 disposed in the interim area between adjusting lever 81 and drag lever 88.

The adjustable stop assembly is provided with a pin 96 and further includes a cam-shaped extension 97 at its free end in the actuating area of pin 83. The pin 96 is connected to a pressure piston 98 disposed in a cylinder 87 and displaceable counter to the pressure of the return spring 99, with the side end face of the piston being effected by the pressure of the fuel-injection pump. The pressure in chamber 94 enclosed by the backside of the piston is released by an adjustable throttle 100. The front and back sides of the piston are connected via a throttle bore 101. Throttle 100 is adjustable in accordance with the temperature and determines the onset point for displacing piston 98. Throttle bore 101 allows for constant ventilation of the fuel suction chamber of the combustion engine.

When starting the engine, the piston 98 is in a fully extended position toward the right, whereby contour 97 allows for the farthest deflection of adjusting lever 81 in the actuating direction of starter spring 85. In this position the annular slide element 16 will result in a high fuel-injection quantity.

FIG. 4 shows the starting position of the above-referenced device. Thereby, in the starting position, drag lever 88 abuts stop 30 and adjusting lever 81 by way of pin 83 abuts adjustable stop 84. The clearance between stop 86 and drag lever 88 corresponds with the maximum adjusting distance of adjusting lever 81 along contour 97 as well as the maximum starting injection quantity. At a load-free condition on the engine, the idling spring 93 is released, and stop 95 disengages from drag lever 88, as shown. With no fuel pressure from the pressure pump, the reverse spring 99 is released and piston 98 is displaced to the right to its farthest position in the direction of the pressure force of starter spring 85. After starting the engine, and with increased rpm the adjusting sleeve 39 displaces drag lever 88 through clearance a, thereby contacting stop 86 on the adjusting lever 81. Thus, at idling-load both levers are displaced counter to the pressure of the idling spring 93 and starter spring 85, with the annular ring element 16 being moved downwardly in the direction of decreased fuel injection quantity. Also, with increased rpm and increased fuel pressure, piston 98 is displaced and upon opening of throttle 100 stop 84 is brought into an actuating position.

At partial load operation, stop 95 is in constant abutment with drag lever 88 due to the force of the adjusting sleeve 39. If during this mode of service, the operation is changed to full-load, pin 83 will initially be moved to stop 84, thus defining maximum fuel-injection quantity. Non-related thereto, drag lever 88 can return to stop 30.

Thus, by way of a simple construction, this device fulfills in most advantageous fashion the requirement that only minimal pressure be exerted on the adjusting lever 84, thus avoiding great hysteresis behavior and adjustment errors during the adjusting process.

Also, the impact imposed on stop 84 by the lever assembly is minimal, thus favorably influencing oscillation. In this device, release of the adjustable full-load stop 84 during starting the engine is favorably influenced even in interdependency with other operating parameters, i.e., temperature, by controlling throttle 100 in accordance with and in a known fashion.

A variant to the exemplary embodiment in accordance with FIG. 4 is shown in FIG. 5. In FIG. 5, an angle lever 103 including non-stop arm 102 and stop-related end 107 is provided instead of adjusting lever 84; the angle lever pivots around a fixed housing shaft 104. The non-stop arm 102 of the angle lever is engaged by an adjusting pin 105 of an adjusting device 106, whereby the adjusting pin is adjustable in accordance with different operating parameters. This operation is effected in dependency with the density of air introduced into the combustion chambers. The stop-related end 107 of the angle lever 103 is loaded by a holding spring 108 which presses the non-stop arm 102 against the adjusting pin 105. For the release of the adjustable stop at start, a disengaging element is provided in the form of a starter piston 110. Starter piston 110 is displaceable toward a reverse spring 109 in a bore 112 of the injection pump wall, and with its face end projects into the suction chamber 7. The starter piston 110 is thereby placed parallel to the adjusting pin 105 and affects the angle lever 103. The back side 111 of the starter piston encloses a pressure chamber 113 in bore 112, with the pressure chamber 113 being released via a release conduit 114 which is provided with a throttle 115. Furthermore, piston 110 includes a blind bore 116 extending into pressure chamber 113, and a throttle bore 117 which extends through the surface of the starter piston into blind bore 116. When the starter piston is extended, the throttle bore is shut off by the wall of cylindrical bore 112. However, if pressure in the suction chamber is too low, the starter piston will be projected from the cylindrical bore 112 to the extent that throttle bore 117 communicates with the suction chamber. In this position, the fuel may flow off in the direction of the release side by way of throttle bore 117 and the throttle 115. This is particularly applicable during start of the engine. The projected starter piston further displaces the angle lever 103 counter to the pressure of reverse spring 108. The degree of deflection of the angle lever 103 during starting of the engine is limited by a temperature-dependent adjustable stop 118. In accordance with the outward deflected position of the angle lever 103, it is also possible to deflect adjusting lever 81 which adjusts the annular slide element 16 in the direction of increased fuel injection, i.e., the annular slide element 16 is placed in the fuel starting position. The fuel starting quantity is adjusted in accordance with the temperature-dependent adjustable stop 118.

Following start of the fuel-injection pump the pressure in suction chamber 7 increases so that the starter piston is pushed into cylinder bore 112 counter to the pressure of reverse spring 109. Displacement of angle lever 103 follows accordingly. This displacement is coordinated with throttle bore 117 in connection with throttle 115. As soon as throttle bore 117 is closed off by cylindrical bore 112, release movement of the starter piston, which remains submerged, follows instantaneously. The throttle bore 117 functions as a threshold limit switch, whereby dimensioning in connection with throttle 115 produces the desired hysteresis effect during the switching process.

The extended exemplary embodiment according to FIG. 5 shows an idling spring in connection with an intermediate spring for control purposes. In this instance, the spring disc 92' acts as a support assembly for an idling spring 93, and simultaneously as a support assembly for an intermediate spring 119. The intermediate spring 119 is disposed in a housing 120 which at the same time serves as a stop for a spring disc 121 at the other end of governor spring assembly 23. At relative motion of armature 90 toward adjusting lever 81, spring disc 121 engages adjusting lever 81 and with additional movement of armature 90 and arm 81, spring disc 92' will be displaced to a point where contact with housing 120 is established. Compression of the idling spring 93' results in simultaneous compression of intermediate spring 119. This will improve transition between idling and part-load operation. During a smooth transition, the intermediate spring 119 is not pre-stressed, whereas a more distinct transition will result in pre-stressing of intermediate spring 119.

Adjustment of the adjusting lever, as shown by way of example, can thus be achieved in an advantageous and space-economizing fashion while at the same time providing the desired characteristics for releasing and metering the fuel starting quantity.

FIG. 6 is a variation of the angle lever 103 shown in FIG. 5. The angle lever 103' is constructed as a triple-arm lever with a first lever arm 122 communicating with the adjusting pin 105 and the starter piston 110, a second lever arm 123 which is an extension to lever arm 122 extends across a pivot shaft 104; and a third arm 124 which acts as a stop for the adjusting lever 81 and which projects in a right angle from first lever 122. Lever arm 123 is effected by the reverse spring 108 which is supported by a wall disposed parallel to the second lever arm alongside the pump piston housing. Additionally, a temperature-dependent adjustable stop 118 serves as an engagement point for the second lever arm 123 when the first lever arm 122 is deflected outwardly by the pump piston 110.

A seventh exemplary embodiment is shown in FIG. 7. In this embodiment, a dual-arm adjusting lever 126 is provided, one arm 127 pivoting about shaft 132 and coupled in known fashion with annular slide element 16. The other arm 128 is in direct communication with an adjusting pin 105 which is actuated by an adjusting device 106, and previously shown in exemplary embodiments FIGS. 5 and 6. Lever arm 128 is perpendicular to adjusting pin 105 and is stressed by a starter piston 110 in accordance with the example shown in FIG. 5 or 6. The lever arm is adjustable counter to the pressure of a reverse spring 129. The outward deflection of lever arm 128 counter to the reverse spring 129 is defined by a temperature-dependent adjustable stop 130.

The dual-arm adjusting lever 126 is pivotable around a shaft 132 which is disposed on the end of one arm of a dual-arm drag lever 133. The dual-arm drag lever pivots around an adjustable shaft 134 which is secured to the housing. An arm 136 of the drag lever 133 communicates with an adjusting sleeve 39 of known design, as set forth above, and a governor spring assembly 23 is suspended at the end of arm 136 opposite from pivot 134. The mode of operation is basically identical as in exemplary embodiment FIG. 5. During starting the engine, the adjusting lever 126 is forced onto stop 130 by starter piston 110, thus the annular slide element 16 is displaced to its starting position at which the fuel pump injects the greatest fuel-injection quantity into the cylinders of the engine. The drag lever 133 thereby abuts stop 130, and the adjusting sleeve 39 is in the starting position. At the start of the operation, the starting piston 110 will be pushed back by the increased pressure in suction chamber 7, through throttle bore 117, to a point where the starting piston snaps back completely upon covering of throttle bore 117. The adjusting lever affected by reverse spring 129 is thereby placed at the adjustable stop defining full-load fuel quantity. The adjustable stop is implemented by the adjusting pin 105. If partial load instead of full load is selected, drag lever 133 is deflected from the adjusting sleeve 39 with increased rpm, resulting in displacement of the shaft 132 and dual-arm control lever 126 which pivots on shaft 132, thereby placing the annular slide element 16 in a direction of low fuel injection quantity. Thus, adjustment of the adjusting lever 126 is favorably influenced without subjecting the latter to the high forces of the governor spring assembly. Reverse spring 129 serves as the only support force acting in opposition to adjusting pin 105, which is subsequently adjustable in a friction- and hysteresis-poor fashion in accordance with the operating parameters through control 106. Furthermore, elimination of the angle lever set forth in FIG. 5 will allow for a space-conducive provision of the controlling device.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A controlling device for a fuel-quantity adjustment element of a fuel injection pump including a dual-arm adjusting lever pivotable around a shaft, said adjusting lever being coupled with a fuel-quantity adjustment element, a drag lever pivotable around said shaft of the adjusting lever, a governor spring assembly which stresses said drag lever with a variable load/rpm-dependent pressure, a first stop for stopping said drag lever, said adjusting lever communicates with said drag lever by way of a pivotable intermediate lever, a first stop which defines movement of said intermediate lever relative to said drag lever, a second stop which limits the distance between said intermediate lever and said adjusting lever, whereby a first compression spring is disposed between said intermediate lever and said drag lever, and a second compression spring is disposed between said intermediate lever and said adjusting lever, further including a device for generating rpm-dependent pressure transmittable to the drag lever via an adjusting sleeve and counter to a force of the governor spring assembly, whereby the drag lever and the adjusting lever are coupled at least at the end of each relative movement effected by the actuating element; the drag lever and the adjusting lever being jointly adjustable by the adjusting sleeve, characterized in that said adjusting lever communicates with at least one adjustable stop in dependence from the operating parameters of a combustion engine.

2. A controlling device as defined by claim 1, characterized in that said adjustable stop is moved into an outset position at starting of the combustion engine.

3. A controlling device as defined by claim 1, characterized in that the intermediate lever is disposed at the joint pivoting point of said adjusting lever and said drag lever.

4. A controlling device as defined by claim 1, characterized in that the shaft on which the drag lever pivots is adjustable.

* * * * *